US010497496B2

(12) United States Patent
Machida et al.

(10) Patent No.: US 10,497,496 B2
(45) Date of Patent: Dec. 3, 2019

(54) RARE EARTH-COBALT PERMANENT MAGNET

(71) Applicant: TOKIN Corporation, Sendai-shi, Miyagi (JP)

(72) Inventors: Hiroaki Machida, Sendai (JP); Teruhiko Fujiwara, Sendai (JP); Hideyuki Yoshikawa, Sendai (JP)

(73) Assignee: TOKIN CORPORATION, Sendai-Shi, Miyagi (JP)

( * ) Notice: Subject to any disclaimer, the term of this patent is extended or adjusted under 35 U.S.C. 154(b) by 574 days.

(21) Appl. No.: 14/846,558

(22) Filed: Sep. 4, 2015

(65) Prior Publication Data

US 2015/0380134 A1 Dec. 31, 2015

Related U.S. Application Data

(63) Continuation-in-part of application No. 14/643,875, filed on Mar. 10, 2015, now abandoned.

(30) Foreign Application Priority Data

Mar. 11, 2014 (JP) ..... 2014-047031
Mar. 9, 2015 (JP) ..... 2015-045875

(51) Int. Cl.
*H01F 1/055* (2006.01)
*H01F 1/058* (2006.01)
(Continued)

(52) U.S. Cl.
CPC ..... *H01F 1/055* (2013.01); *C22C 1/0433* (2013.01); *C22C 19/07* (2013.01); *C22C 30/02* (2013.01);
(Continued)

(58) Field of Classification Search
None
See application file for complete search history.

(56) References Cited

U.S. PATENT DOCUMENTS

2002/0054825 A1 5/2002 Sukaki et al.
2007/0221296 A1 9/2007 Enokido et al.
(Continued)

FOREIGN PATENT DOCUMENTS

CN 1947208 A 4/2007
CN 103312055 A 9/2013
(Continued)

OTHER PUBLICATIONS

Huang et al. (J of Applied Physics, 1994, vol. 75, p. 6280-6282).*
(Continued)

*Primary Examiner* — Xiaowei Su
(74) *Attorney, Agent, or Firm* — Procopio, Cory, Hargreaves & Savitch LLP

(57) ABSTRACT

There is provided a rare earth-cobalt permanent magnet containing 23 to 27 wt % R, 3.5 to 5 wt % Cu, 18 to 25 wt % Fe, 1.5 to 3 wt % Zr, and a remainder Co with inevitable impurities, where an element R is a rare earth element at least containing Sm. It has a metal structure including a cell phase (11) containing $Sm_2Co_{17}$ phase and a cell wall (12) surrounding the cell phase (11) and containing $SmCo_5$ phase.

2 Claims, 6 Drawing Sheets

(51) Int. Cl.

| | |
|---|---|
| ***C22C 19/07*** | (2006.01) |
| ***C22C 30/02*** | (2006.01) |
| ***C22C 1/04*** | (2006.01) |
| *B22F 9/04* | (2006.01) |

(52) U.S. Cl.
CPC ..... *H01F 1/0557* (2013.01); *B22F 9/04* (2013.01); *B22F 2998/10* (2013.01); *C22C 1/0441* (2013.01)

(56) References Cited

U.S. PATENT DOCUMENTS

| | | | | |
|---|---|---|---|---|
| 2013/0082559 | A1 | 4/2013 | Hagiwara et al. | |
| 2013/0241682 | A1 | 9/2013 | Horiuchi et al. | |
| 2014/0139061 | A1 | 5/2014 | Horiuchi et al. | |
| 2014/0139064 | A1* | 5/2014 | Horiuchi | H01F 1/01 310/156.01 |
| 2014/0139305 | A1* | 5/2014 | Horiuchi | H01F 1/01 335/302 |
| 2015/0262740 | A1* | 9/2015 | Fujiwara | H01F 1/055 420/435 |

FOREIGN PATENT DOCUMENTS

| | | | | |
|---|---|---|---|---|
| CN | 103839639 | A | 6/2014 | |
| CN | 104916382 | A | 9/2015 | |
| EP | 1127358 | B1 * | 6/2009 | H01F 1/0551 |
| JP | H7-211568 | A | 8/1995 | |
| JP | 2002-083727 | A | 3/2002 | |
| JP | 2013-74235 | A | 4/2013 | |

OTHER PUBLICATIONS

Tian (Rare Metals, 2007, vol. 26, p. 299-304).*
Horiuchi (Materials Transactions, 2014, vol. 55, No. 3, p. 482-488. Published Feb. 25, 2014.*
First Notification of Office Action for CN App No. 201510105486.X dated Nov. 1, 2017, 13 pgs.
Office Action for related CN Patent Application No. 201510574229.0 dated Nov. 21, 2018; English translation provided; 18 pages.
Notification of Reason for Refusal for related Japanese Patent Application No. 2015-045875, dated Sep. 4, 2018; English translation provided; 9 pages.

* cited by examiner

RARE EARTH-COBALT PERMANENT MAGNET

INCORPORATION BY REFERENCE

This application is a continuation-in-part (CIP) Application of commonly-assigned, co-pending, U.S. patent application Ser. No. 14/643,875, filed on Mar. 10, 2015, which is based upon and claims the benefit of priority from Japanese patent application No. 2014-047031, filed on Mar. 11, 2014, the disclosure of which is incorporated herein in their entirety by reference.

This application is based upon and claims the benefit of priority from Japanese patent application No. 2015-045875, filed on Mar. 9, 2015, the disclosure of which is incorporated herein in its entirety by reference.

BACKGROUND OF THE INVENTION

1. Field of the Invention

The present invention relates to a rare earth-cobalt permanent magnet.

2. Description of Related Art

Examples of rare earth-cobalt permanent magnets include a samarium-cobalt magnet that contains 14.5 wt % Fe. Further, a samarium-cobalt magnet with higher Fe content is made to improve the energy product.

For example, the samarium-cobalt magnet obtained using an alloy consisting of 20 to 30 wt % RE (RE is Sm or two or more kinds of rare earth elements containing 50 wt % or more Sm), 10 to 45 wt % Fe, 1 to 10 wt % Cu, 0.5 to 5 wt % Zr, and the remainder Co with inevitable impurities is disclosed in Japanese Unexamined Patent Application Publication No. 2002-083727. To be specific, strip casting is used to cast the alloy and obtain a thin piece. The strip casting is a method that drops the molten alloy onto a water-cooled copper roll and produces a thin piece with a thickness of about 1 mm. Then, the obtained thin piece is placed in a non-oxidizing atmosphere and heat-treated, then ground to powder. The powder is then compression-molded in a magnetic field and further undergoes sintering, solution treatment and ageing treatment in this order.

SUMMARY OF THE INVENTION

There is a demand for a rare earth-cobalt permanent magnet with good magnetic properties.

The present invention has been accomplished in view of the above-noted circumstances, and an object of the present invention is thus to provide a rare earth-cobalt permanent magnet with good magnetic properties.

A rare earth-cobalt permanent magnet according to the present invention is a rare earth-cobalt permanent magnet containing 23 to 27 wt % R, 3.5 to 5 wt % Cu, 18 to 25 wt % Fe, 1.5 to 3 wt % Zr, and a remainder Co with inevitable impurities, where an element R is a rare earth element at least containing Sm, wherein the rare earth-cobalt permanent magnet has a metal structure including a cell phase containing $Sm_2Co_{17}$ phase and a cell wall surrounding the cell phase and containing $SmCo_5$ phase.

Further, the rare earth-cobalt permanent magnet may contain 19 to 25 wt % Fe and have a density of 8.15 to 8.39 g/cm$^3$, an average crystal grain diameter may have within a range of 40 to 100 μm, and a half width of Cu content of the cell wall may be 10 nm or less.

Further, when a diffraction intensity I(220) of a plane (220) of the cell phase and a diffraction intensity I(303) of a plane (303) of the cell phase are measured using powder X-ray diffractometry, a diffraction intensity ratio I(220)/I(303) may satisfy $0.65 \leq I(220)/I(303) \leq 0.75$.

According to the present invention, it is possible to provide a rare earth-cobalt permanent magnet with good magnetic properties.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

Figure 1:
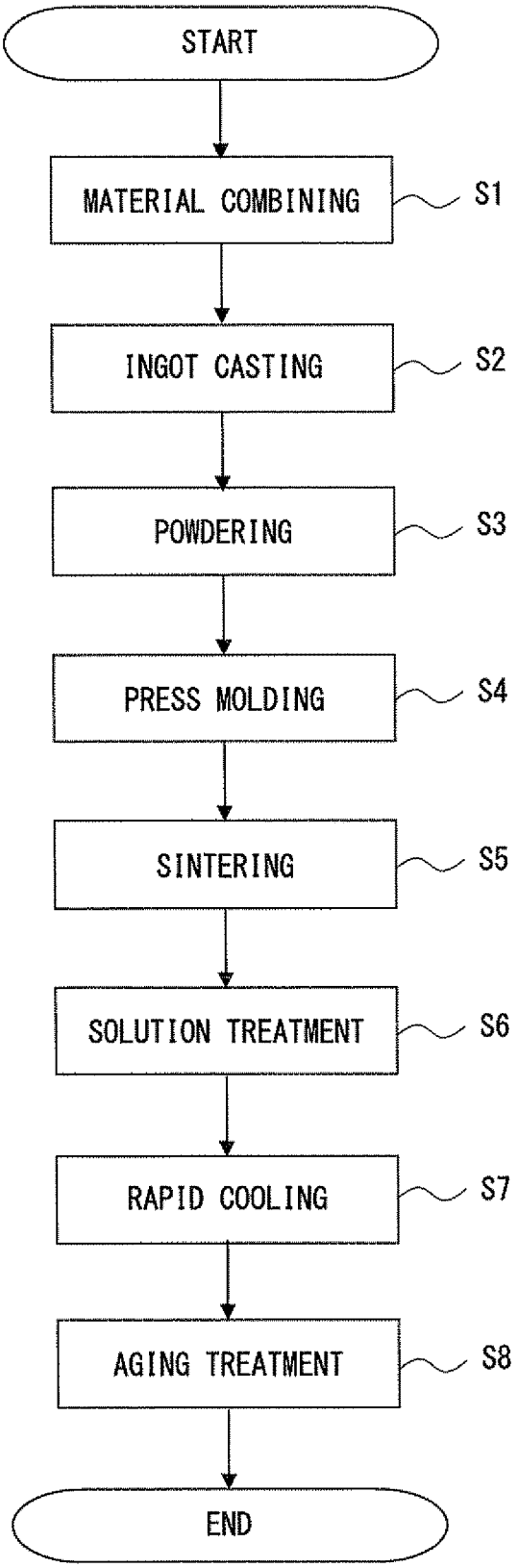
FIG. 1 is a flowchart showing a rare earth-cobalt permanent magnet production method according to a first embodiment.

The present inventors have found that it is important that the composition is homogenized in a microstructure in solution treatment and thus focused attention on raw material preparation. Particularly, among the element content of the rare earth-cobalt permanent magnet, the melting point of pure Zr is 1852° C., which is far higher than about 1400° C., the melting point of an alloy having the same composition as the permanent magnet, and therefore there has been a concern about the uneven distribution of the element Zr in the microstructure. The present inventors have made intensive studies on a raw material, a production method and the like and have accomplished the present invention.

First Embodiment

A rare earth-cobalt permanent magnet according to a first embodiment is described hereinafter.

The rare earth-cobalt permanent magnet according to the first embodiment contains 23 to 27 wt % R, 3.5 to 5 wt % Cu, 19 to 25 wt % Fe, 1.5 to 3 wt % Zr, and the remainder Co with inevitable impurities. The melting point of the rare earth-cobalt permanent magnet according to the first embodiment is about 1400° C. R is a rare earth element and at least contains Sm among rare earth elements. Examples of rare earth elements include Pr, Nd, Ce and La. Further, the rare earth-cobalt permanent magnet according to the first embodiment contains an intermetallic compound that is composed predominantly of rare earth cobalt. The intermetallic compound may be $SmCo_5$, $Sm_2CO_{17}$ or the like, for example.

Further, the rare earth-cobalt permanent magnet according to the first embodiment has a metal structure containing crystal grains. The crystal grains have a cell phase containing $Sm_2Co_{17}$, a cell wall surrounding the cell phase and containing $SmCo_5$, and a plate phase containing Zr. Further, in the rare earth-cobalt permanent magnet according to the first embodiment, a structure in a sub-micron size is formed inside the crystal grain, and further a concentration difference in an alloy composition exists between the cell phase and the cell wall, and particularly, Cu is concentrated on the cell wall. The rare earth-cobalt permanent magnet according to the first embodiment contains more Fe than the existing samarium-cobalt magnet. Accordingly, the rare earth-cobalt permanent magnet according to the first embodiment has a high coercive force and high squareness as the magnetic properties. Further, as Cu is concentrated on the cell wall, the squareness of the rare earth-cobalt permanent magnet is expected to increase.

The rare earth-cobalt permanent magnet according to the first embodiment can be widely used as various parts of a clock, an electric motor, a measuring instrument, telecommunication equipment, a computer terminal, a speaker, a video disk, a sensor and other equipment. Further, because the magnetic force of the rare earth-cobalt permanent magnet according to the first embodiment resists being degraded under high ambient temperature, and application to an angle sensor, an ignition coil used in a vehicle engine room, a drive motor of HEV (Hybrid electric vehicle) and the like is expected.

Production Method

A method of producing the permanent magnet according to the first embodiment is described hereinafter with reference to FIG. 1.

First, a rare earth element, pure Fe, pure Cu, pure Co, and a master alloy containing Zr are prepared as raw materials, and those materials are combined in the above-described specified composition (material combining step S1). The master alloy is a binary alloy that generally consists of two different metal elements and is used as a dissolving material. Further, the master alloy containing Zr has a composition with a lower melting point than 1852° C., the melting point of pure Zr. The melting point of the master alloy containing Zr is preferably equal to or lower than the temperature that dissolves the rare earth-cobalt permanent magnet according to the first embodiment, which is 1600° C. or lower, and more preferably 1000° C. or lower.

Examples of the master alloy containing Zr include FeZr alloy and CuZr alloy. The FeZr alloy and CuZr alloy are preferable because they have a low melting point and therefore Zr is dispersed uniformly throughout an ingot structure, which is described later. Accordingly, the FeZr alloy and CuZr alloy having an eutectic composition or a similar composition are preferable because the melting point is suppressed to be 1000° C. or lower. To be specific, the FeZr alloy is 20% Fe-80% Zr alloy, for example. The 20% Fe-80% Zr alloy contains 75 to 85 wt % Zr and the remainder Fe with inevitable impurities. The CuZr alloy is 50% Cu-50% Zr alloy, for example. The 50% Cu-50% Zr alloy contains 45 to 55 wt % Zr and the remainder Cu with inevitable impurities.

Then, the combined materials are charged into an alumina crucible, dissolved by a high-frequency furnace under a vacuum atmosphere or under an inert gas atmosphere with $1\times10^{-2}$ Torr or less, and then casted into a metal mold, thereby obtaining an ingot (ingot casting step S2). The casting method is a method called book molding, for example. Note that the obtained ingot may be heat-treated for about 1 to 20 hours at a solution temperature. By this heat treatment, the structure of the ingot is further homogenized, which is preferable.

Then, the obtained ingot is ground to powder having a specified average particle diameter (powdering step S3). Typically, the obtained ingot is coarsely ground, and further the coarsely ground ingot is finely ground to powder in an inert gas atmosphere by using a jet mill or the like. The average particle diameter (d50) of the powder is 1 to 10 μm, for example. Note that the average particle diameter (d50) is a particle diameter at an integrated value 50% in the particle size distribution obtained by the laser diffraction and scattering method.

After that, the obtained powder is placed in a certain magnetic field, and further the powder is pressurized vertically to the magnetic field and press-molded, thereby obtaining a molded body (press molding step S4). The press molding conditions are a magnetic field of 15 kOe or higher, and a pressure value of press molding of 0.5 to 2.0 ton/cm$^2$, for example.

Then, the molded body is heated to a sintering temperature under a vacuum atmosphere or under an inert gas atmosphere with $1\times10^{-2}$ Torr or less and thereby sintered (sintering step S5). The sintering temperature is 1150° C. to 1250° C., for example.

Then, the molded body is solution-treated at a solution temperature that is lower than the sintering temperature by 20° C. to 70° C. under the same atmosphere condition (solution treatment step S6). The solution time is 2 to 10 hours, for example. Note that the solution time may be varied appropriately according to the structure of the obtained molded body and the target magnetic properties. If the solution time is too short, the composition is not sufficiently homogenized. On the other hand, if the solution time is too long, Sm contained in the molded body evaporates. This produces a difference in composition between the inside and the surface of the molded body, which can cause the degradation of the magnetic properties as a permanent magnet.

Note that, it is preferred to perform the sintering step S5 and the solution treatment step S6 in succession in terms of mass production. In the case of performing the sintering step S5 and the solution treatment step S6 in succession, the temperature is dropped from the sintering temperature to the solution temperature at a low temperature drop rate such as 0.2° C. to 5° C./min, for example. It is preferred that the temperature drop rate is low because Zr is more evenly dispersed throughout the metal structure of the molded body and thus evenly distributed.

Then, the solution-treated sintered body is rapidly cooled at a cooling rate of 300° C./min or more (rapid cooling step S7). Further, the sintered body is continuously heated at a temperature of 700° C. to 870° C. for one hour or more under the same atmosphere condition, and consecutively cooled at a cooling rate of 0.2° C. to 1° C./min until it falls down to at least 600° C. or preferably to 400° C. or lower (aging treatment step S8).

By the above process, the permanent magnet according to the first embodiment is obtained.

In the meantime, metal mold casting allows casting with a simple device compared with strip casting that requires a complex device such as a water-cooled copper roll. According to the first embodiment, it is possible to produce a permanent magnet by using metal mold casting. It is thus possible to produce a permanent magnet having good magnetic properties with use of a simple device.

Experiment 1

Hereinafter, experiments conducted as examples 1 to 3 for the permanent magnet according to the first embodiment and comparative examples 1 and 2 are described with reference to Table 1 and FIGS. 2, 3, 5 and 6.

In the examples 1 to 3, a permanent magnet was produced by the same production method as described above. To be specific, in the material combining step S1, a target composition was 25.0 wt % Sm, 4.4 wt % Cu, 20.0 wt % Fe, 2.4 wt % Zr, and the remainder Co. As the master alloy containing Zr, 20% Fe-80% Zr alloy was used. Further, in the powdering step S3, an ingot was finely ground to powder with an average particle diameter (d50) of 6 μm in an inert gas atmosphere by using a jet mill. In the press molding step S4, press molding was performed under the conditions of a magnetic field of 15 kOe and a press-molding pressure value of 1.0 ton/cm$^2$. In the sintering step S5, sintering was performed at a sintering temperature of 1200° C. In the solution treatment step S6, the temperature was dropped to the solution temperature at a temperature drop rate of 1° C./min, and solution treatment was performed for four hours at a solution temperature of 1170° C. In the rapid cooling step S7, rapid cooling was performed at a cooling rate of 300° C./min. In the aging treatment step S8, isothermal aging treatment was performed by continuously heating the sintered body for ten hours at a temperature of 850° C. in the inert gas atmosphere and, after that, continuous aging treatment was performed to 350° C. at a cooling rate of 0.5° C./min, thereby obtaining a permanent magnet material. The properties of the magnet obtained in this method were shown in Table 1 as the example 1.

In the example 2, a permanent magnet was produced by the same production method as the example 1 except that heat treatment that continuously heats the ingot for fifteen hours at 1170° C. was performed after the ingot casting step S2.

In the example 3, a permanent magnet was produced by the same production method as the production method of the permanent magnet according to the first embodiment described above except for the material combining step S1. In the production method of the example 3, 50% Cu-50% Zr alloy was used instead of 20% Fe-80% Zr alloy in the material combining step S1.

Note that, in the comparative example 1, a permanent magnet was produced by the same production method as the production method of the permanent magnet according to the first embodiment described above except for the material combining step S1. In the production method of the comparative example 1, Zr metal called zirconium sponge was used instead of 20% Fe-80% Zr alloy in the step corresponding to in the material combining step S1.

In the comparative example 2, a permanent magnet was produced by the same production method as the production method of the permanent magnet according to the first embodiment described above except for the ingot casting step S2. In the production method of the comparative example 2, strip casting was used in the step corresponding to the ingot casting step S2.

The magnetic properties in the examples 1 to 3 and the comparative examples 1 and 2 were measured. The measured magnetic properties were a remanence Br[T], a coercive force Hcj[kA/m], a maximum energy product (BH)max [kJ/m$^3$], and squareness Hk/Hcj[%]. The squareness Hk/Hcj indicates the squareness of a demagnetization curve, and a larger value indicates better magnetic properties. Hk is a value of Hc when B at a remanence Br of 90% and the demagnetization curve intersect. Further, a density and an average crystal grain diameter were also measured. The measured results are shown in Table 1. Further, the a-plane of the crystal of the cross-sectional structures in the example 1 and the comparative example 1 was observed using TEM (Transmission Electron Microscope). Further, the composition of each element in those cross-sectional structures was measured using TEM-EDX (Transmission Electron Microscope Energy Dispersive X-ray Spectroscopy).

TABLE 1

| | Br (T) | HcJ (kA/m) | (BH) max (kJ/m$^3$) | Hk/HcJ (%) | Density ($10^3$ × kg/m$^3$) | Average crystal grain diameter (μm) |
|---|---|---|---|---|---|---|
| Example 1 | 1.15 | 1760 | 248 | 60 | 8.28 | 65 |
| Example 2 | 1.15 | 1680 | 252 | 64 | 8.28 | 80 |
| Example 3 | 1.15 | 1720 | 244 | 56 | 8.28 | 60 |
| Comparative Example 1 | 1.15 | 1440 | 198 | 45 | 8.28 | 80 |
| Comparative Example 2 | 1.10 | 2080 | 216 | 47 | 8.36 | 35 |

As shown in Table 1, in the example 1, in comparison with the comparative example 1, the remanence Br was the same level, the coercive force Hcj was 1200 kA/m or more, the energy product (BH)max was 200 kJ/m$^3$ or more, and the squareness Hk/Hcj was 50% or more, all of which were suitable values. It is considered that this is because, in the example 1, FeZr alloy was used as a material and sufficiently dissolved in the ingot casting step S2, and thereby Zr was evenly distributed in the metal structure. On the other hand, it is considered that, in the comparative example 1, Zr metal called zirconium sponge was used and not sufficiently dissolved compared with the example 1 in the ingot casting step S2, and consequently Zr was unevenly distributed in the metal structure. Further, it was confirmed that the density of the permanent magnet obtained by the same production method as in the examples 1 to 3 was within the range of at least 8.15 to 8.39 g/cm$^3$.

In the example 2, the energy product (BH)max was higher compared with the example 1. It is considered that this is because the ingot was heat-treated after the ingot casting step S2 in the example 2, and thereby the metal structure was homogenized.

In the example 3, CuZr alloy was used instead of FeZr alloy as a material, and good magnetic properties were measured as in the example 1. It is considered that this is because the CuZr alloy, which was used as a material in this example, was also sufficiently dissolved in the ingot casting step S2, and Zr was evenly distributed in the metal structure.

On the other hand, it is considered that, in the comparative example 2, in comparison with the example 1, while the density and the coercive force Hcj were high, the remanence Br, the maximum energy product (BH)max and the squareness Hk/Hcj were low. Further, because the remanence Br was low despite that the density was high, it is considered that the degree of orientation of the crystal axis was low. A part of the reason for this is because the average crystal grain diameter was smaller than that of the examples 1 to 3 and the comparative example 1. It is preferred that the average crystal grain diameter is within the range of 40 to 100 nm because the permanent magnet can have the suitable remanence Br, maximum energy product (BH)max and squareness Hk/Hcj.

Figure 2:
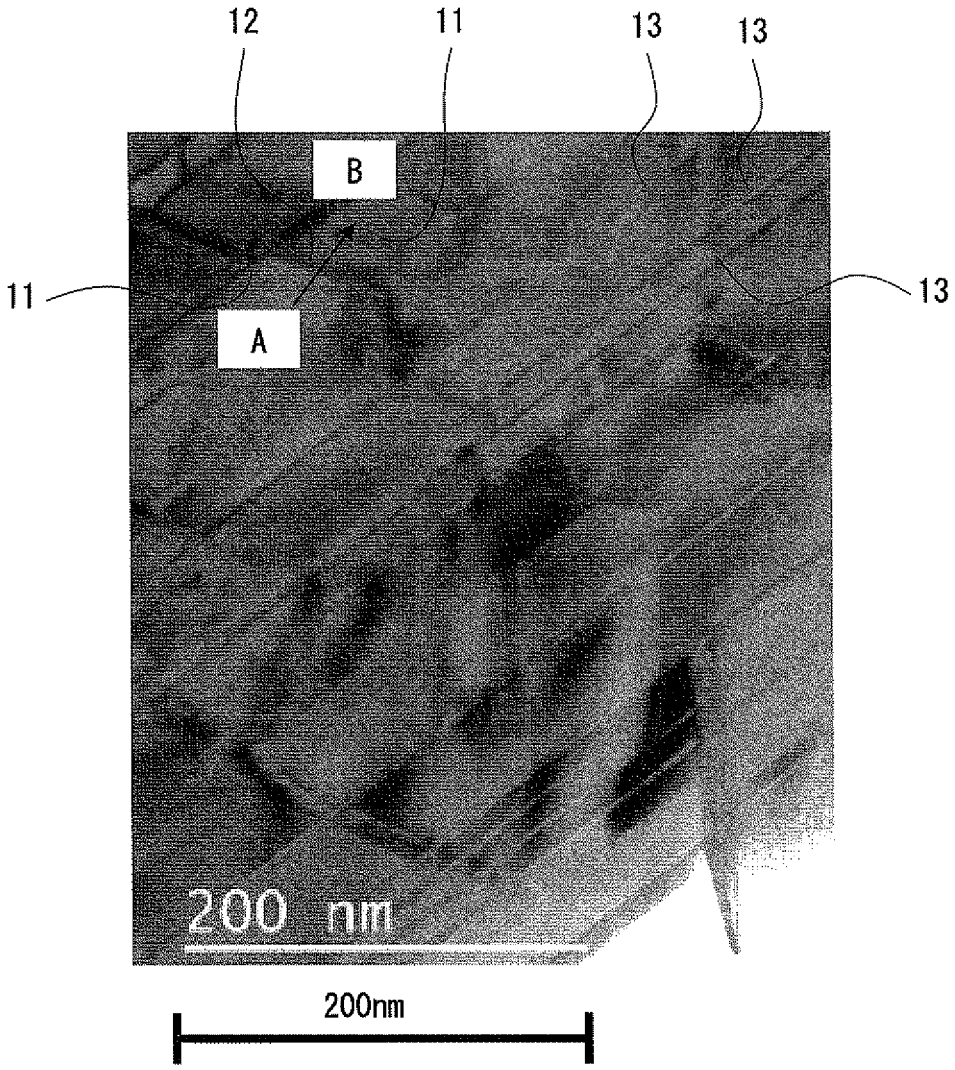
FIG. 2 is a cross-sectional photograph showing a microstructure in an example 1.
Figure 5:
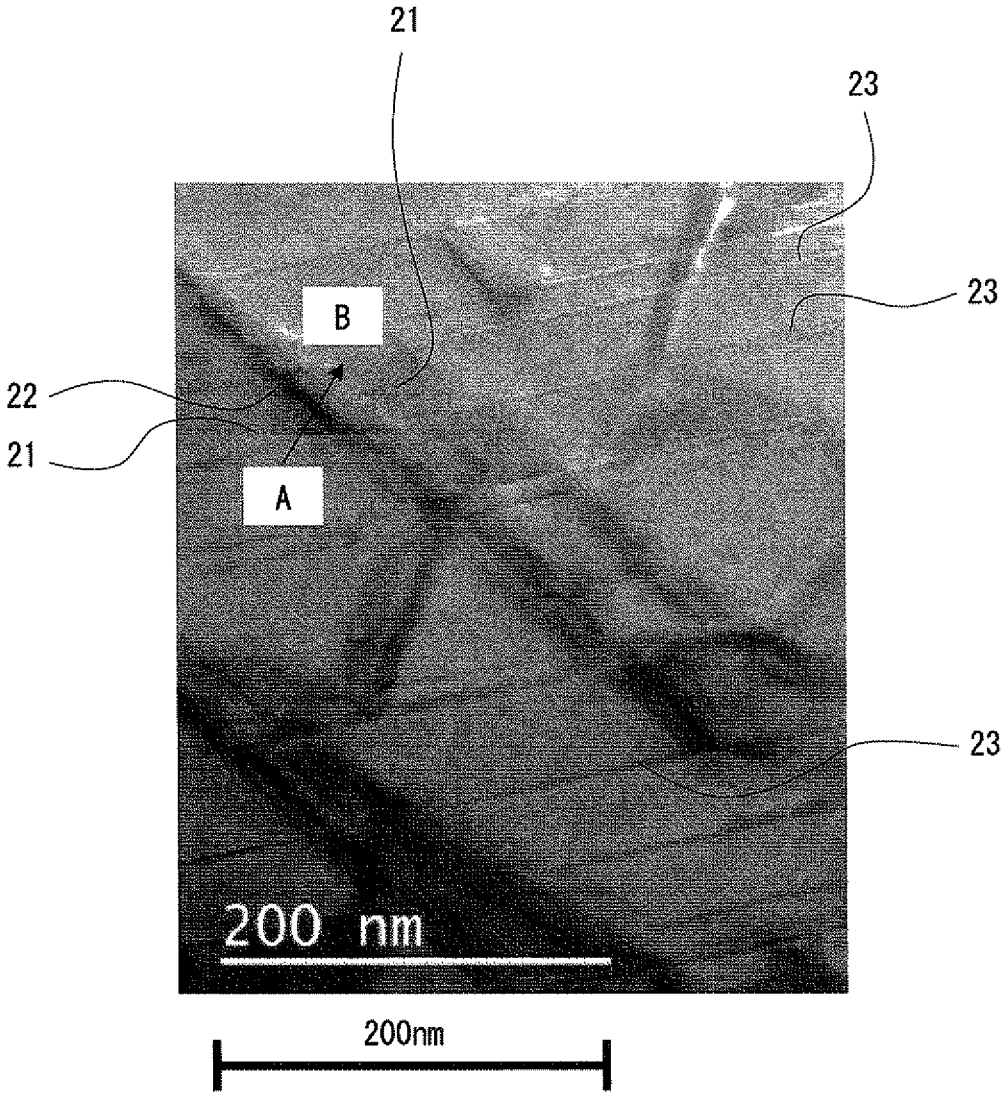
FIG. 5 is a cross-sectional photograph showing a microstructure in a comparative example 1.

As shown in FIG. 2, in the cross-sectional structure of the example 1, the cell phases 11, the cell walls 12 and the plate phases 13 containing Zr were found in the crystal grain. The cell phases 11 contain $Sm_2Co_{17}$ phases, and the cell walls 12 contain $SmCo_5$ phases and are placed to surround the cell phases 11. The plate phases 13 containing Zr are plate-like phases containing Zr and are arranged in a certain direction in the crystal grains. As shown in FIG. 5, in the cross-sectional structure of the comparative example 1 also, cell phases 21, cell walls 22 and plate phases 23 containing Zr were found just like in the cross-sectional structure of the example 1.

Figure 3:
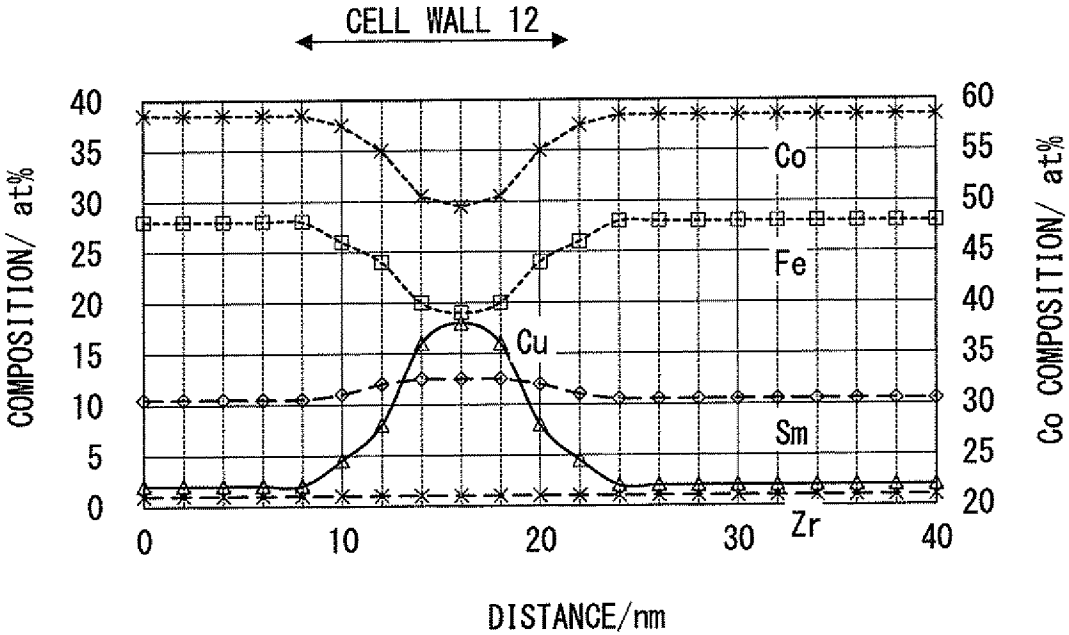
FIG. 3 shows each composition with respect to distance in the example 1.
Figure 6:
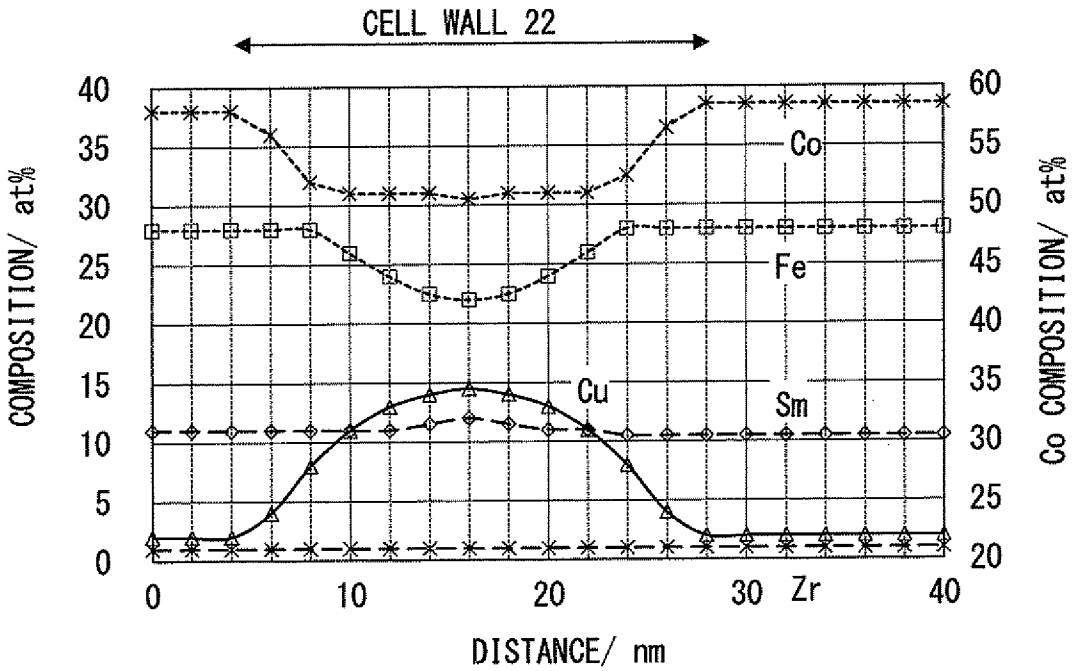
FIG. 6 shows each composition with respect to distance in the comparative example 1.

As shown in FIGS. 2 and 5, in the example 1 and the comparative example 1, each element composition was analyzed at intervals of 2 nm to go across the cell wall 12 from A to B. As shown in FIG. 3, in the example 1, the Cu composition reached its peak in the cell wall 12. The maximum value was 18.0 at %, and the half width of the peak was 8 nm. Further, as shown in FIG. 6, in the comparative example 1, the Cu composition reached its peak in the cell wall 22. The maximum value was 14.5 at %, which is lower than that of the example 1, and the half width of the peak was 11 nm, which is larger than that of the example 1. In the example 1, the peak of the Cu composition was higher and steeper compared with the comparative example 1, it is considered that the maximum energy product (BH)max and the squareness Hk/Hcj were high. Therefore, good magnetic properties were obtained in the example 1, and it is thus preferable as the permanent magnet. Further, it is preferred that the maximum value of the Cu composition of the cell wall is 15 at % or more because good magnetic properties are obtained. Furthermore, it is preferred that the half width of the peak of the Cu composition is 10 nm because the permanent magnet can have good magnetic properties.

Experiment 2

Hereinafter, experiments conducted as examples 4 to 15 for the permanent magnet according to the first embodiment and comparative examples 3 to 10 are described with reference to Table 2.

In the examples 4 to 15, materials were prepared with the component shown in Table 2 as a target composition, and a permanent magnet was produced by the same production method as the example 1. Further, the magnetic properties of the examples 4 to 15 and the comparative examples 3 to 10 were measured. Furthermore, each element composition of the cell wall in the examples 4 to 15 was measured in the same way as in the example 1 and the comparative example 1.

As shown in Table 2, in the examples 4 and 5, the coercive force Hcj was 1200 kA/m or more, the energy product (BH)max was 200 kJ/$m^3$ or more, and the squareness Hk/Hcj was 50% or more, all of which were suitable values. On the other hand, in the comparative example 3, the content of Sm was smaller, 22.5 wt %, and the coercive force Hcj, the energy product (BH)max and the squareness Hk/Hcj were smaller in comparison with the examples 4 and 5. In the comparison example 4, the content of Sm was larger, 27.5 wt %, and the coercive force Hcj, the energy product (BH)max and the squareness Hk/Hcj were smaller in comparison with the examples 4 and 5. Accordingly, it is considered that, if the content of Sm is 23 to 27 wt %, the coercive force Hcj, the energy product (BH)max and the squareness Hk/Hcj are suitable values.

Further, in the examples 6 to 9, as in the examples 4 and 5, the coercive force Hcj was 1200 kA/m or more, the energy product (BH)max was 200 kJ/$m^3$ or more, and the squareness Hk/Hcj was 50% or more, all of which were suitable values. On the other hand, in the comparative example 5, the content of Fe was smaller, 18.5 wt %, and the coercive force Hcj, the energy product (BH)max and the squareness Hk/Hcj were smaller in comparison with the examples 6 to 9. In the comparison example 6, the content of Fe was larger, 25.5 wt %, and the coercive force Hcj, the energy product (BH)max and the squareness Hk/Hcj were smaller in comparison with the examples 6 to 9. Accordingly, it is considered that, if the

TABLE 2

| | Br (T) | HcJ (kA/m) | (BH)max (kJ/$m^3$) | Hk/HcJ (%) | Sm | Fe | Cu (wt %) | Zr | Co |
|---|---|---|---|---|---|---|---|---|---|
| Comparative Example 3 | 1.10 | 720 | 192 | 43 | 22.5 | 20.0 | 4.4 | 2.5 | Remainder |
| Example 4 | 1.17 | 1280 | 244 | 55 | 23.0 | 20.0 | 4.4 | 2.5 | Remainder |
| Example 5 | 1.13 | 1240 | 240 | 54 | 27.0 | 20.0 | 4.4 | 2.5 | Remainder |
| Comparative Example 4 | 1.10 | 760 | 188 | 41 | 27.5 | 20.0 | 4.4 | 2.5 | Remainder |
| Comparative Example 5 | 1.13 | 1150 | 194 | 35 | 25.0 | 18.5 | 4.4 | 2.5 | Remainder |
| Example 6 | 1.14 | 1360 | 240 | 52 | 25.0 | 19.0 | 4.4 | 2.5 | Remainder |
| Example 7 | 1.17 | 1720 | 252 | 58 | 25.0 | 22.0 | 4.4 | 2.5 | Remainder |
| Example 8 | 1.19 | 1680 | 248 | 54 | 25.0 | 24.0 | 4.4 | 2.5 | Remainder |
| Example 9 | 1.20 | 1280 | 240 | 50 | 25.0 | 25.0 | 4.4 | 2.5 | Remainder |
| Comparative Example 6 | 1.18 | 760 | 190 | 35 | 25.0 | 25.5 | 4.4 | 2.5 | Remainder |
| Comparative Example 7 | 1.15 | 780 | 200 | 36 | 25.0 | 20.0 | 3.3 | 2.5 | Remainder |
| Example 10 | 1.17 | 1240 | 240 | 51 | 25.0 | 20.0 | 3.5 | 2.5 | Remainder |
| Example 11 | 1.16 | 1680 | 244 | 55 | 25.0 | 20.0 | 4.0 | 2.5 | Remainder |
| Example 12 | 1.14 | 1780 | 240 | 52 | 25.0 | 20.0 | 5.0 | 2.5 | Remainder |
| Comparative Example 8 | 1.12 | 1280 | 192 | 33 | 25.0 | 20.0 | 5.2 | 2.5 | Remainder |
| Comparative Example 9 | 1.15 | 750 | 195 | 43 | 25.0 | 20.0 | 4.4 | 1.3 | Remainder |
| Example 13 | 1.19 | 1280 | 244 | 51 | 25.0 | 20.0 | 4.4 | 1.5 | Remainder |
| Example 14 | 1.17 | 1720 | 252 | 58 | 25.0 | 20.0 | 4.4 | 2.0 | Remainder |
| Example 15 | 1.13 | 1200 | 244 | 55 | 25.0 | 20.0 | 4.4 | 3.0 | Remainder |
| Comparative Example 10 | 1.11 | 730 | 197 | 45 | 25.0 | 20.0 | 4.4 | 3.2 | Remainder |

content of Fe is 19 to 25 wt %, the coercive force Hcj, the energy product (BH)max and the squareness Hk/Hcj are suitable values.

Further, in the examples 10 to 12, as in the examples 4 to 9, the coercive force Hcj was 1200 kA/m or more, the energy product (BH)max was 200 kJ/m$^3$ or more, and the squareness Hk/Hcj was 50% or more, all of which were suitable values. On the other hand, in the comparative example 7, the content of Cu was smaller, 3.3 wt %, and the coercive force Hcj and the squareness Hk/Hcj were smaller in comparison with the examples 10 to 12. In the comparison example 8, the content of Cu was larger, 5.2 wt %, and the energy product (BH)max and the squareness Hk/Hcj were smaller in comparison with the examples 10 to 12. Accordingly, it is considered that, if the content of Cu is 3.5 to 5.0 wt %, the coercive force Hcj, the energy product (BH)max and the squareness Hk/Hcj are suitable values.

Further, in the examples 13 to 15, as in the examples 4 to 12, the coercive force Hcj was 1200 kA/m or more, the energy product (BH)max was 200 kJ/m$^3$ or more, and the squareness Hk/Hcj was 50% or more, all of which were suitable values. On the other hand, in the comparative example 9, the content of Zr was smaller, 1.3 wt %, and the coercive force Hcj, the energy product (BH)max and the squareness Hk/Hcj were smaller in comparison with the examples 13 to 15. In the comparison example 10, the content of Zr was larger, 3.2 wt %, and the coercive force Hcj, the energy product (BH)max and the squareness Hk/Hcj were smaller in comparison with the examples 13 to 15. Accordingly, it is considered that, if the content of Zr is 1.5 to 3.0 wt %, the coercive force Hcj, the energy product (BH)max and the squareness Hk/Hcj are suitable values.

Note that, each element composition of the cell wall in the examples 4 to 15 was measured in the same way as in the example 1 and the comparative example 1. As a result, in the cell wall, the maximum value of the Cu composition was 15 at % or more.

Experiment 3

Hereinafter, experiments conducted as examples 16 to 19 for the permanent magnet according to the first embodiment and comparative examples 11 and 12 are described with reference to Table 3.

TABLE 3

| | Br (T) | HcJ (kA/m) | (BH) max (kJ/m$^3$) | Hk/HcJ (%) | C (ppm) | O (ppm) | Al (ppm) |
|---|---|---|---|---|---|---|---|
| Example 16 | 1.15 | 1760 | 248 | 60 | 200 | 3000 | 500 |
| Example 17 | 1.12 | 1600 | 240 | 50 | 1000 | 3000 | 500 |
| Comparative Example 11 | 1.08 | 1440 | 195 | 35 | 1100 | 3000 | 500 |
| Example 18 | 1.17 | 1760 | 252 | 62 | 500 | 1000 | 500 |
| Example 19 | 1.13 | 1680 | 244 | 51 | 500 | 5000 | 500 |
| Comparative Example 12 | 1.10 | 1400 | 196 | 40 | 500 | 5250 | 500 |

In the examples 16 to 19, a permanent magnet was produced by the same production method as in the example 1 except that a target composition was an alloy consisting of 24.5 to 25.5 wt % Sm, 4.3 wt % Cu, 20.0 wt % Fe, 2.4 wt % Zr, and the remainder Co and that the content of C (Carbon), O (Oxygen) and Al as inevitable impurities were varied as shown in Table 3. The content of C (Carbon) was adjusted by changing the amount of a lubricant such as stearic acid or an addition method in the press molding step S4. The content of O (Oxygen) was adjusted by changing the particle diameter or the like at the time of fine grinding in the powdering step S3. The content of Al was adjusted by adding pure Al in the material combining step S1. Further, the magnetic properties of the examples 16 to 19 and the comparative examples and 12 were measured. Furthermore, each element composition of the cell wall in the examples 16 to 19 was measured in the same way as in the example 1 and the comparative example 1.

As shown in Table 3, in the examples 16 and 17, as in the examples 1 to 15, the coercive force Hcj was 1200 kA/m or more, the energy product (BH)max was 200 kJ/m$^3$ or more, and the squareness Hk/Hcj was 50% or more, all of which were suitable values. On the other hand, in the comparative example 11, the content of C was larger, 1100 ppm, and the energy product (BH)max was smaller in comparison with the examples 16 and 17. Thus, if the content of C as an inevitable impurity is restricted to 200 to 1000 ppm, good magnetic properties are obtained.

In the examples 18 and 19, as in the examples 1 to 15, the coercive force Hcj was 1200 kA/m or more, the energy product (BH)max was 200 kJ/m$^3$ or more, and the squareness Hk/Hcj was 50% or more, all of which were suitable values. On the other hand, in the comparative example 12, the content of 0 was larger, 5250 ppm, and the energy product (BH)max and the squareness Hk/Hcj were smaller in comparison with the examples 18 and 19. Thus, if the content of 0 as an inevitable impurity is restricted to 1000 to 5000 ppm or more preferably 1000 to 3500 ppm, good magnetic properties are obtained.

Note that, each element composition of the cell wall in the examples 16 to 19 was measured in the same way as in the example 1 and the comparative example 1. As a result, in the cell wall, the maximum value of the Cu composition was 15 at % or more.

Second Embodiment

A rare earth-cobalt permanent magnet according to a second embodiment is described hereinafter.

The rare earth-cobalt permanent magnet according to the second embodiment contains 23 to 27 wt % R, 3.5 to 5 wt % Cu, 18 to 25 wt % Fe, 1.5 to 3 wt % Zr, and the remainder Co with inevitable impurities. R is a rare earth element and at least contains Sm among rare earth elements. Examples of rare earth elements include Pr, Nd, Ce and La. Further, the rare earth-cobalt permanent magnet according to the second embodiment contains an intermetallic compound that is composed predominantly of rare earth cobalt. The intermetallic compound may be $SmCo_5$, $Sm_2Co_{17}$ or the like, for example.

Further, the rare earth-cobalt permanent magnet according to the second embodiment has a metal structure containing crystal grains. The crystal grains have a cell phase containing $Sm_2Co_{17}$, a cell wall surrounding the cell phase and containing $SmCo_5$, and a plate phase containing Zr. The cell phase is a main phase. In the rare earth-cobalt permanent magnet according to the second embodiment, it is considered that a high coercive force is exerted because of pinning of a magnetic wall by the cell phase and the cell wall. Fe and Cu are concentrated on the cell phase and the cell wall, respectively. The squareness Hk/Hcj of the rare earth-cobalt permanent magnet according to the second embodiment is thereby improved, and the maximum energy product (BH) max increases.

In the meantime, one means to examine a crystal structure is powder X-ray diffractometry. A lattice constant and a space group are known from a peak position and peak shape, and even the substances having the same composition and the same crystal structure have a different peak intensity ratio due to a difference in the atomic arrangement in the crystal structure. When the atomic arrangement is different, the magnetocrystalline anisotropy of a sublattice in the $Th_2Zn_{17}$ type structure differs, which directly affects the magnetic properties.

In the rare earth-cobalt permanent magnet according to the second embodiment, the cell phase has $Th_2Zn_{17}$ type structure. The first peak (peak at which the intensity is the highest) of the cell phase is a plane (303), and the second peak is the a (220). Particularly, the plane (303) serves as one index indicating the concentration of Fe in a transition metal element, particularly, Fe in $Sm_2Co_{17}$. In the rare earth-cobalt permanent magnet according to the second embodiment, a diffraction intensity ratio I(220)/I(303) of diffraction intensities of the plane (220) of the cell phase and the plane (303) of the cell phase satisfy the following relational expression 1.

$$0.65 \leq I(220)/I(303) \leq 0.75 \quad (\ldots \text{Relational expression 1})$$

Note that the diffraction intensities of the plane (220) of the cell phase and the plane (303) of the cell phase are measured using the above-described powder X-ray diffractometry. When the concentration of Fe in the cell phase is low, the diffraction intensity ratio I(220)/I(303) is large. On the other hand, when the concentration of Fe in the cell phase is excessively high to exhibit soft magnetic properties, the diffraction intensity ratio I(220)/I(303) is small.

Further, in the rare earth-cobalt permanent magnet according to the second embodiment, just like the permanent magnet according to the first embodiment, a structure in a sub-micron size may be formed inside the crystal grain, and further a concentration difference in an alloy composition may exist between the cell phase and the cell wall, and particularly, Cu may be concentrated on the cell wall. The rare earth-cobalt permanent magnet according to this embodiment may contain more Fe than the existing samarium-cobalt magnet. Accordingly, the rare earth-cobalt permanent magnet according to this embodiment has a high coercive force and high squareness as the magnetic properties. Further, as Cu is concentrated on the cell wall, the squareness of the rare earth-cobalt permanent magnet is expected to increase.

The permanent magnet according to the second embodiment, just like the permanent magnet according to the first embodiment, can be widely used as various parts of a clock, an electric motor, a measuring instrument, telecommunication equipment, a computer terminal, a speaker, a video disk, a sensor and other equipment. Further, because the magnetic force of the permanent magnet according to the second embodiment resists being degraded under high ambient temperature, application to an angle sensor, an ignition coil used in a vehicle engine room, a drive motor of HEV (Hybrid electric vehicle) and the like is expected.

Production Method 2

A method of producing the permanent magnet according to the second embodiment is described hereinafter.

First, the material combining step S1 and the ingot casting step S2 are performed in the same manner as in the method of producing the permanent magnet according to the first embodiment.

Note that, instead of the ingot casting step S2, a strip casting step S22 may be performed. The strip casting step S22 drops molten metal onto a copper roll to form a solidified piece. The molten metal is formed by melting of the material combined in the material combining step S1. The thickness of the solidified piece is 1 mm, for example.

Next, the obtained ingot is ground to powder having a specified average particle diameter (powdering step S23). Typically, the obtained ingot is coarsely ground to obtain coarse powder. The average particle diameter (d50) of the coarse powder is 100 to 500 μm, for example. Further, the coarse powder is finely ground to powder in an inert gas atmosphere by using a jet mill or the like. The average particle diameter (d50) of the powder is 1 to 10 μm, and, to be specific, about 6 μm, for example.

After that, the obtained powder is placed in a certain magnetic field, and further the powder is pressurized vertically to the magnetic field and press-molded, thereby obtaining a molded body (press molding step S24). The press molding conditions are a magnetic field of 15 kOe (=1193.7 kA/m) or higher, and a pressure value of press molding of 0.5 to 2.0 ton/cm$^2$, for example. Note that, according to a product, a magnetic field may be equal to or less than 15 kOe (=1193.7 kA/m), and the above-described powder may be pressurized horizontally to the magnetic field and press-molded. The conversion of between CGS and SI units may be done using the following conversion formulas 1 and 2.

$$1[\text{kOe}]=10^3/4\pi[\text{kA/m}] \quad (\ldots \text{Conversion formula 1})$$

$$1[\text{MGOe}]=10^2/4\pi[\text{kJ/m}^3] \quad (\ldots \text{Conversion formula 2})$$

Then, the sintering step S5 is performed in the same manner as in the method of producing the permanent magnet according to the first embodiment. In the sintering step S5, a sintering time is preferably 30 to 150 minutes. A sintering time of 30 minutes or longer is preferable because the molded body becomes closely packed. Further, a sintering time of 150 minutes or shorter is preferable because excessive evaporation of Sm is prevented to avoid the degradation of the magnetic properties.

After that, under the same atmosphere condition, the molded body is solution-treated at a specified solution treatment temperature Tt (solution treatment step S26). Then, 1-7 phases containing $SmCo_7$ are formed in a metal structure of the molded body. The 1-7 phases are precursors to be separated into cell phases containing $Sm_2Co_{17}$ and cell walls containing $SmCo_5$. The solution treatment temperature Tt is 1120° C. to 1190° C., for example, and it may be varied according to the structure of the molded body. A solution time is preferably 2 to 20 hours, and more preferably 2 to 10 hours. Note that the solution time may be varied appropriately according to the structure of the obtained molded body and the target magnetic properties. If the solution time is too short, the composition is not sufficiently homogenized. On the other hand, if the solution time is too long, Sm contained in the molded body evaporates. This produces a difference in composition between the inside and the surface of the molded body, which can cause the degradation of the magnetic properties as a permanent magnet.

Note that, it is preferred to perform the sintering step S5 and the solution treatment step S26 in succession in terms of mass production.

Then, the solution-treated molded body is rapidly cooled at a specified cooling rate Tc1 (rapid cooling step S27). The 1-7 phases can be thereby kept in the metal structure of the molded body. It is preferred to rapidly cool the molded body when it is 600° C. to 1000° C. Further, the cooling rate Tc1 is 60° C./min or more, for example, and preferably 70° C./min or more, and more preferably 80° C./min or more.

The cooling rate Tc1 is preferably such temperature because $Sm_2Co_{17}$ in the cell phases of the molded body can be maintained more reliably.

Further, under the same atmosphere condition, the molded body is continuously heated at a specified retention temperature Tk for 2 to 20 hours or more, and consecutively cooled at a cooling rate Tc2 until it falls down to 400° C. or lower (aging treatment step S28). In the metal structure of the molded body, the 1-7 phases are separated into cell phases containing $Sm_2Co_{17}$ and cell walls containing $SmCo_5$, and the cell phases and the cell walls are homogenized. The retention temperature Tk is 700° C. to 900° C., for example, and preferably 800° C. to 850° C. The cooling rate Tc2 is preferably 2.0° C./min or less, and more preferably 0.5° C./min or less. The cooling rate Tc2 is preferably in this range because Fe and Cu are concentrated on the cell phase and the cell wall, respectively.

By the above process, the permanent magnet according to the second embodiment is obtained. The permanent magnet according to the second embodiment has good magnetic properties.

Measurement Method 1

A measurement method for measuring the diffraction intensity of the permanent magnet according to the second embodiment using powder X-ray diffraction is described hereinafter.

First, the permanent magnet according to the second embodiment is polished to remove a surface layer that is not magnetized. Specifically, the permanent magnet is polished using a sandpaper, a belt grinder or the like. The belt grinder is a device where an abrasive-coated belt rotates. The surface layer is an oxide layer, for example.

Next, the polished permanent magnet is ground to powder. Specifically, the permanent magnet is ground using a mortar or the like. The obtained powder has an average particle diameter (d50) of 100 μm or less, for example.

Figure 4:
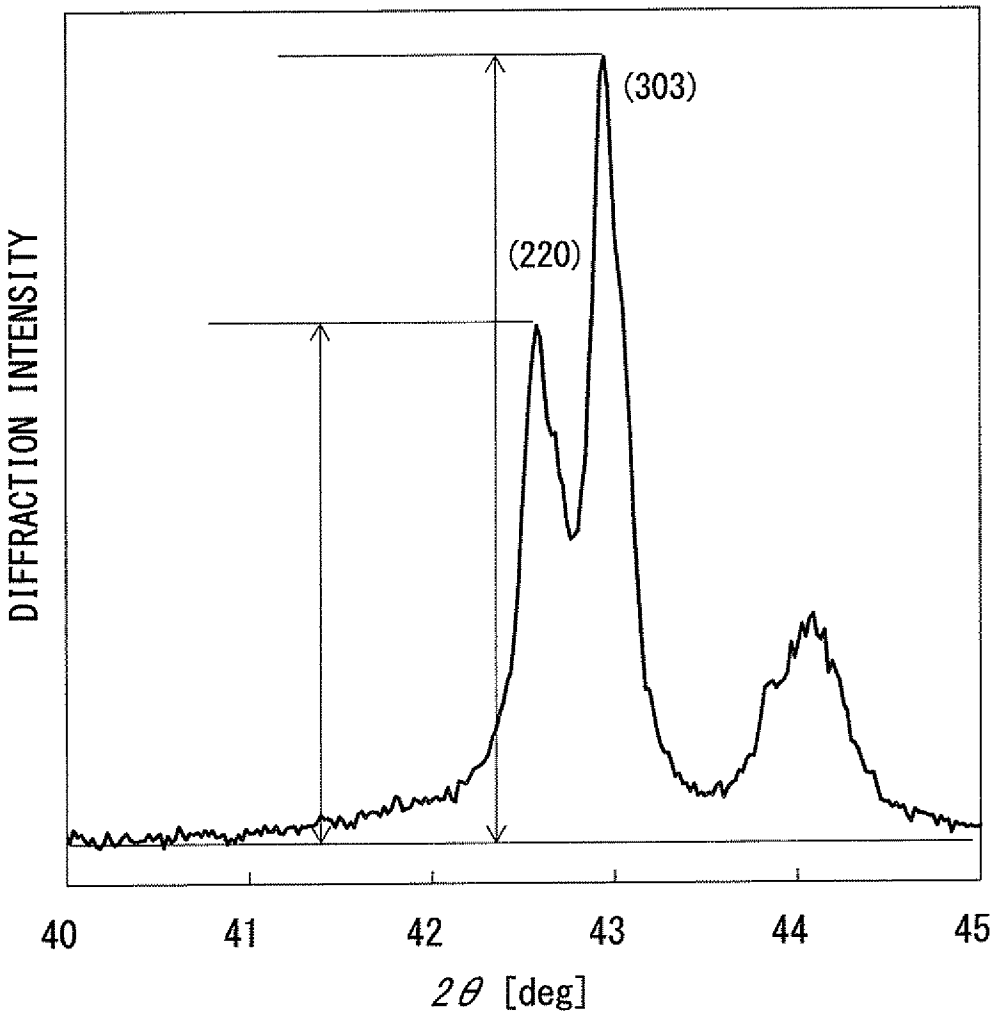
FIG. 4 is a graph showing diffraction intensity with respect to diffraction angle 2θ.

Then, X-rays are applied using an X-ray diffraction unit to measure the diffraction intensity. Specifically, the obtained powder is filled into a sample holder of the X-ray diffraction unit. The obtained powder is evened out so that the X-ray incidence plane becomes flat. As the powder X-ray diffractometry, 2θ method was used. As a radiation source of the X-ray diffraction unit, Cu—Kα radiation was used. The conditions for measurement were a measuring angle interval of 0.02°, a measuring rate of 5°/min. As shown in FIG. 4, after the measurement, the peak intensities of the plane 220 and the plane 303 are obtained, subtracting the background. Further, the diffraction intensity ratio I(220)/I(303) is calculated from those.

Example

Experiment 4

Hereinafter, experiments conducted as examples 21 to 31 for the permanent magnet according to the second embodiment and comparative examples 21 to 30 are described.

In the examples 21 to 31, permanent magnets were produced by the same method as the production method 2 of the permanent magnet according to the second embodiment described above. To be more specific, in the material combining step S1, materials were prepared with the component shown in Table 4 as a target composition. As raw materials, 20% Fe-80% Zr alloy was used.

TABLE 4

| | Composition | Cooling rate Tc1 [° C./min] | Maximum energy product (BH) max [MGOe] | Coercive force Hcj [kOe] | Diffraction intensity ratio I(220)/I(303) |
|---|---|---|---|---|---|
| Example 21 | $Sm_{25.7}Fe_{19.8}Cu_{4.33}Zr_{2.08}Co_{bal}$ | 80 | 31.3 | 27.6 | 0.703 |
| Example 22 | $Sm_{25.7}Fe_{19.8}Cu_{4.33}Zr_{2.08}Co_{bal}$ | 70 | 31.0 | 25.8 | 0.698 |
| Example 23 | $Sm_{25.7}Fe_{19.8}Cu_{4.33}Zr_{2.08}Co_{bal}$ | 60 | 30.7 | 23.5 | 0.678 |
| Comparative Example 21 | $Sm_{25.7}Fe_{19.8}Cu_{4.33}Zr_{2.08}Co_{bal}$ | 50 | 29.3 | 20.5 | 0.763 |
| Comparative Example 22 | $Sm_{25.7}Fe_{19.8}Cu_{4.33}Zr_{2.08}Co_{bal}$ | 40 | 28.5 | 18.6 | 0.785 |
| Example 24 | $Sm_{23.0}Fe_{20.0}Cu_{4.4}Zr_{2.15}Co_{bal}$ | 80 | 30.0 | 22.2 | 0.654 |
| Example 25 | $Sm_{27.0}Fe_{20.0}Cu_{4.4}Zr_{2.15}Co_{bal}$ | 80 | 30.2 | 20.5 | 0.742 |
| Example 26 | $Sm_{26.0}Fe_{18.0}Cu_{4.25}Zr_{2.1}Co_{bal}$ | 80 | 30.8 | 24.3 | 0.677 |
| Example 27 | $Sm_{26.0}Fe_{25.0}Cu_{4.5}Zr_{2.15}Co_{bal}$ | 80 | 31.3 | 20.6 | 0.741 |
| Example 28 | $Sm_{25.9}Fe_{19.8}Cu_{3.5}Zr_{2.10}Co_{bal}$ | 80 | 30.8 | 30.0 | 0.738 |
| Example 29 | $Sm_{25.9}Fe_{19.8}Cu_{5.0}Zr_{2.10}Co_{bal}$ | 80 | 31.3 | 25.5 | 0.667 |
| Example 30 | $Sm_{25.5}Fe_{19.8}Cu_{4.5}Zr_{1.5}Co_{bal}$ | 80 | 31.5 | 26.7 | 0.742 |
| Example 31 | $Sm_{25.5}Fe_{19.8}Cu_{4.5}Zr_{3.0}Co_{bal}$ | 80 | 31.2 | 29.4 | 0.701 |
| Comparative Example 23 | $Sm_{22.0}Fe_{20.0}Cu_{4.4}Zr_{2.15}Co_{bal}$ | 80 | 25.3 | 15.0 | 0.617 |
| Comparative Example 24 | $Sm_{28.0}Fe_{20.0}Cu_{4.4}Zr_{2.15}Co_{bal}$ | 80 | 28.5 | 16.5 | 0.776 |
| Comparative Example 25 | $Sm_{26.0}Fe_{17.0}Cu_{4.25}Zr_{2.1}Co_{bal}$ | 80 | 30.0 | 17.3 | 0.785 |
| Comparative Example 26 | $Sm_{26.0}Fe_{26.0}Cu_{4.25}Zr_{2.1}Co_{bal}$ | 80 | 23.0 | 5.0 | 0.634 |
| Comparative Example 27 | $Sm_{25.9}Fe_{19.8}Cu_{3.0}Zr_{2.10}Co_{bal}$ | 80 | 29.5 | 28.5 | 0.808 |
| Comparative Example 28 | $Sm_{25.9}Fe_{19.8}Cu_{5.5}Zr_{2.10}Co_{bal}$ | 80 | 29.3 | 25.5 | 0.636 |
| Comparative Example 29 | $Sm_{25.5}Fe_{19.8}Cu_{4.5}Zr_{1.0}Co_{bal}$ | 80 | 28.7 | 16.1 | 0.833 |
| Comparative Example 30 | $Sm_{25.5}Fe_{19.8}Cu_{4.5}Zr_{3.5}Co_{bal}$ | 80 | 27.5 | 12.2 | 0.643 |

In the powdering step S23, the average particle diameter (d50) of the obtained powder was approximately 6 μm. In the press molding step S24, a magnetic field was 15 kOe (=1193.7 kA/m), and a pressure was 1.0 ton/cm$^2$. In the sintering step S5, a sintering temperature was 1200° C., and a sintering time was 1.5 hour. In the solution treatment step S26, a solution treatment temperature Tt was 1170° C., and a solution treatment time was 4 hours. In the rapid cooling step S27, the molded body was rapidly cooled from 1000° C. to 600° C. The cooling rate Tc1 was the value shown in Table 4. In the aging treatment step S28, the molded body was continuously heated at a retention temperature Tk of 850° C. for 10 hours and consecutively cooled at the cooling rate Tc2 until it falls down to 350° C. The cooling rate Tc2 was 0.5° C./min. By the above process, the permanent magnets in the examples 21 to 31 were obtained.

Next, the magnetic properties and the X-ray diffraction intensity in the examples 21 to 31 were measured. Note that, the permanent magnets in the examples 21 to 31 were ground using a mortar made of a steel material. The measured magnetic properties and X-ray diffraction intensity are shown in Table 4.

Note that, in the comparative examples 21 to 30, permanent magnet were produced by the same production method as in the examples 21 to 31 except for the material combining step S1 and the rapid cooling step S27. To be more specific, in a material combining step corresponding to the material combining step S1, materials were prepared with the component shown in Table 4 as a target composition. In a rapid cooling step corresponding to the rapid cooling step S27, rapid cooling from 1000° C. to 600° C. was done. The cooling rate Tc1 is the value shown in Table 4.

In the experiment 4, it is determined that good magnetic properties are achieved when the maximum energy product (BH)max is 30 MGOe (=238.7 kJ/m$^3$) or more, and the coercive force Hcj is 20 kOe (=1591.6 kA/m) or more.

As shown in Table 4, in the examples 21 to 23, the maximum energy product (BH)max is 30 MGOe or more, and the coercive force Hcj is 20 kOe or more, and therefore good magnetic properties are obtained. Further, because the diffraction intensity ratio I(220)/I(303) is between 0.65 and 0.75, the relational expression 1 is satisfied.

On the other hand, in the comparative examples 21 and 22, the maximum energy product (BH)max was less than 30 MGOe, and the coercive force Hcj was less than 20 kOe. Therefore, in the comparative examples 21 and 22, it was not determined that good magnetic properties were achieved. Further, because the diffraction intensity ratio I(220)/I(303) was more than 0.75, the relational expression 1 was not satisfied. In the comparative examples 21 and 22, it is considered that, while materials in the same target composition as in the examples 21 to 23 were used, because the cooling rate Tc1 was lower than the cooling rate Tc1 in the examples 21 to 23, the 1-7 phases could not be kept in the metal structure, and good magnetic properties were not maintained. Accordingly, it is considered that good magnetic properties would be obtained more reliably if the cooling rate Tc1 in the rapid cooling step S27 is 60° C./min or more.

In the examples 24 to 31, the target composition is 23.0 to 27.0 wt % Sm, 18.0 to 25.0 wt % Fe, 3.5 to 5.0 wt % Cu, 1.5 to 3.0 wt % Zr, and a remainder Co with inevitable impurities. In the examples 24 to 31, the maximum energy product (BH)max is 30 MGOe or more, and the coercive force Hcj is 20 kOe or more, and therefore good magnetic properties are obtained. Further, because the diffraction intensity ratio I(220)/I(303) is between 0.65 and 0.75, the relational expression 1 is satisfied.

On the other hand, in the comparative example 23, the content of Sm in the target composition is 22.0 wt %, which is lower than that in the example 24, and the maximum energy product (BH)max is less than 30 MGOe, and the coercive force Hcj is less than 20 kOe, and therefore good magnetic properties are not achieved. Further, because the diffraction intensity ratio I(220)/I(303) is less than 0.65, the relational expression 1 is not satisfied.

Further, in the comparative example 24, the content of Sm in the target composition is 28.0 wt %, which is higher than that in the example 25, and the maximum energy product (BH)max is less than 30 MGOe, and the coercive force Hcj is less than 20 kOe, and therefore good magnetic properties are not achieved. Further, because the diffraction intensity ratio I(220)/I(303) is more than 0.75, the relational expression 1 is not satisfied.

Accordingly, it is considered that good magnetic properties would be obtained more reliably if the content of Sm in the target composition is 23.0 to 27.0 wt %. The content of Sm in the target composition is preferably 23.0 to 27.0 wt %, more preferably 24.0 to 26.0 wt %, and further preferably 24.5 to 25.5 wt %.

On the other hand, in the comparative example 25, the content of Fe in the target composition is 17.0 wt %, which is lower than that in the example 26, and the maximum energy product (BH)max is less than 30 MGOe, and the coercive force Hcj is less than 20 kOe, and therefore good magnetic properties are not achieved. Further, because the diffraction intensity ratio I(220)/I(303) is more than 0.75, the relational expression 1 is not satisfied.

Further, in the comparative example 26, the content of Fe in the target composition is 26.0 wt %, which is higher than that in the example 27, and the maximum energy product (BH)max is less than 30 MGOe, and the coercive force Hcj is less than 20 kOe, and therefore good magnetic properties are not achieved. Further, because the diffraction intensity ratio I(220)/I(303) is less than 0.65, the relational expression 1 is not satisfied.

Accordingly, it is considered that good magnetic properties would be obtained more reliably if the content of Fe in the target composition is 18.0 to 25.0 wt %. The content of Fe in the target composition is preferably 18.0 to 25.0 wt %.

On the other hand, in the comparative example 27, the content of Cu in the target composition is 3.0 wt %, which is lower than that in the example 28, and the maximum energy product (BH)max is less than 30 MGOe, and the coercive force Hcj is less than 20 kOe, and therefore good magnetic properties are not achieved. Further, because the diffraction intensity ratio I(220)/I(303) is more than 0.75, the relational expression 1 is not satisfied.

Further, in the comparative example 28, the content of Cu in the target composition is 5.5 wt %, which is higher than that in the example 29, and the maximum energy product (BH)max is less than 30 MGOe, and the coercive force Hcj is less than 20 kOe, and therefore good magnetic properties are not achieved. Further, because the diffraction intensity ratio I(220)/I(303) is less than 0.65, the relational expression 1 is not satisfied.

Accordingly, it is considered that good magnetic properties would be obtained more reliably if the content of Cu in the target composition is 3.0 to 5.5 wt %. The content of Cu in the target composition is preferably 3.0 to 5.5 wt %, more preferably 4.0 to 5.0 wt %, and further preferably 4.2 to 5.0 wt %.

On the other hand, in the comparative example 29, the content of Zr in the target composition is 1.0 wt %, which is lower than that in the example 30, and the maximum energy product (BH)max is less than 30 MGOe, and the coercive force Hcj is less than 20 kOe, and therefore good magnetic properties are not achieved. Further, because the diffraction intensity ratio I(220)/I(303) is more than 0.75, the relational expression 1 is not satisfied.

Further, in the comparative example 30, the content of Zr in the target composition is 3.5 wt %, which is higher than that in the example 31, and the maximum energy product (BH)max is less than 30 MGOe, and the coercive force Hcj is less than 20 kOe, and therefore good magnetic properties are not achieved. Further, because the diffraction intensity ratio I(220)/I(303) is less than 0.65, the relational expression 1 is not satisfied.

Accordingly, it is considered that good magnetic properties would be obtained more reliably if the content of Zr in the target composition is 1.5 to 3.0 wt %. The content of Zr in the target composition is preferably 1.5 to 3.0 wt %, and more preferably 2.0 to 2.5 wt %.

Although the exemplary embodiment of the present invention is described in the foregoing, the present invention is not restricted to the above-described configuration, and various changes, modifications and combinations as would be obvious to one skilled in the art may be made without departing from the scope of the invention.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A rare earth-cobalt permanent magnet containing 23 to 27 wt % R, 3.5 to 4.5 wt % Cu, 18 to 25 wt % Fe, 1.5 to 3 wt % Zr, and a remainder Co with inevitable impurities, where an element R is a rare earth element at least comprising Sm, wherein the rare earth-cobalt permanent magnet has a metal structure including a cell phase containing $Sm_2Co_{17}$ phase and a cell wall surrounding the cell phase and containing $SmCo_5$ phase and, when a diffraction intensity I(220) of a plane (220) of the cell phase and a diffraction intensity I(303) of a plane (303) of the cell phase are measured using powder X-ray diffractometry, a diffraction intensity ratio I(220)/I(303) satisfies:

$$0.65 \leq I(220)/I(303) \leq 0.75.$$

2. The rare earth-cobalt permanent magnet according to claim 1, wherein the metal structure comprises a plate phase containing Zr.

* * * * *